US008451257B2

(12) United States Patent
Kim et al.

(10) Patent No.: US 8,451,257 B2
(45) Date of Patent: May 28, 2013

(54) CONTROLLER BOARD, DISPLAY DEVICE HAVING THE SAME AND METHOD OF CONTROLLING THE DISPLAY DEVICE

(75) Inventors: Min-Woo Kim, Anyang-si (KR); On-Sik Choi, Seongnam-si (KR); Do-Wan Kim, Hwaseong-si (KR); Ju-Geun Kim, Yongin-si (KR); Hyun-Il Park, Hwaseong-si (KR); Young-Mook Choi, Namyangju-si (KR)

(73) Assignee: Samsung Display Co., Ltd. (KR)

( * ) Notice: Subject to any disclaimer, the term of this patent is extended or adjusted under 35 U.S.C. 154(b) by 1065 days.

(21) Appl. No.: 12/431,093

(22) Filed: Apr. 28, 2009

(65) Prior Publication Data

US 2009/0284499 A1 Nov. 19, 2009

(30) Foreign Application Priority Data

May 16, 2008 (KR) ..... 10-2008-0045756

(51) Int. Cl.
*G09G 5/00* (2006.01)

(52) U.S. Cl.
USPC ..... 345/204; 345/98

(58) Field of Classification Search
USPC ..... 345/87, 98–100, 204
See application file for complete search history.

(56) References Cited

U.S. PATENT DOCUMENTS

| | | | | |
|---|---|---|---|---|
| 2004/0178984 | A1* | 9/2004 | Park et al. | 345/100 |
| 2005/0008113 | A1 | 1/2005 | Kokubo et al. | |
| 2006/0001632 | A1* | 1/2006 | Katagawa | 345/98 |
| 2007/0273682 | A1* | 11/2007 | Yi et al. | 345/211 |
| 2008/0129668 | A1* | 6/2008 | Ham et al. | 345/87 |
| 2008/0186292 | A1* | 8/2008 | Park et al. | 345/204 |
| 2008/0266317 | A1* | 10/2008 | Tsai | 345/602 |

FOREIGN PATENT DOCUMENTS

| | | | |
|---|---|---|---|
| JP | 2006-333174 | A | 12/2006 |
| KR | 1020030058138 | A | 7/2003 |
| KR | 1020050058048 | A | 6/2005 |
| KR | 1020050096668 | A | 10/2005 |

* cited by examiner

*Primary Examiner* — Amare Mengistu
*Assistant Examiner* — Stacy Khoo
(74) *Attorney, Agent, or Firm* — Cantor Colburn LLP

(57) ABSTRACT

A controller board includes a memory and a timing controller. The memory stores previous frame image data. The timing controller outputs driving image data based on current frame image data supplied from an external device and the previous frame image data. The timing controller disperses a frequency band of the current frame image data within a reference frequency range to generate dispersed current frame image data and transmits the dispersed current frame image data to the memory.

18 Claims, 9 Drawing Sheets

CONTROLLER BOARD, DISPLAY DEVICE HAVING THE SAME AND METHOD OF CONTROLLING THE DISPLAY DEVICE

This application claims priority to Korean Patent Application No. 2008-45756, filed on May 16, 2008, and all the benefits accruing therefrom under 35 U.S.C. §119, the contents of which in its entirety are herein incorporated by reference.

BACKGROUND OF THE INVENTION

1. Field of the Invention

The present invention relates to a controller board, a display device having the controller board, and a method of controlling the display device. More particularly, the present invention relates to a controller board which controls a liquid crystal display device, a display device having the controller board, and a method of controlling the display device.

2. Description of the Related Art

A liquid crystal display ("LCD") device typically includes a display unit, a controller board and a backlight assembly. The display unit displays an image thereon based on a light transmittance of liquid crystal molecules therein. The controller board controls the display unit. The backlight assembly is disposed below the display unit and provides the display unit with light. The display unit typically includes a panel driving part controlled by the controller board and an LCD panel controlled by the panel driving part to display the image.

The controller board typically includes a timing controller and a memory. The timing controller receives current frame data from an external image board and transmits the current frame data to the memory The memory transmits previous frame image data to the timing controller and stores the current frame image data received from the timing controller. To display the image, the timing controller outputs driving image data for driving the display unit based on the current frame image data supplied from the image board and the previous frame image data supplied from the memory.

The timing controller may transmit the current frame image data to the memory in 32-bit units. Likewise, the memory may transmit the previous image data to the memory in 32-bit units. As a result, a large amount of electromagnetic interference ("EMI") is generated, based on the amount of information transmitted by the timing controller and the memory. The EMI has adverse effects on such things as external electronic devices and humans, for example, which are exposed to the EMI.

BRIEF SUMMARY OF THE INVENTION

Exemplary embodiments of the present invention provide a controller board having substantially reduced electromagnetic interference ("EMI") generated when a signal is transmitted between a timing controller and a memory.

Exemplary embodiments of the present invention also provide a display device having the controller board, and a method of controlling the display device with the controller board.

Exemplary embodiments of the present invention also provide a method of controlling the above-mentioned display device.

According to an exemplary embodiment of the present invention, a controller board includes a memory and a timing controller. The memory stores previous image data. The timing controller outputs driving image data based on current frame image data supplied from an external source and the previous frame image data. The timing controller disperses a frequency band of the current frame image data within a reference frequency range to generate dispersed current frame image data and transmits the dispersed current frame image data to the memory.

In an exemplary embodiment of the present invention, the timing controller may include a frequency expanding part, an output buffer, an input buffer and an image signal processing part. The frequency expanding part generates the dispersed current frame image data by dispersing the frequency band of the current frame image data supplied from the external source within the reference frequency range. The output buffer receives the current frame image data from the frequency expanding part and outputs the current frame image data to the memory. The input buffer receives the previous frame image data from the memory and outputs the previous frame image data. The image signal processing part receives the current frame image data from the frequency expanding part and the previous frame image data from the input buffer and outputs the driving image data based on the current frame image data and the previous frame image data.

In an exemplary embodiment of the present invention, the reference frequency range may be from about ±1% to about 3% of a middle frequency of the frequency band of the current frame image data. The middle frequency of the frequency band of the current frame image data may be from about 60 MHz to about 90 MHz.

In an exemplary embodiment of the present invention, a frequency of the current frame image data alternates between a lower frequency and an upper frequency based on a modulation frequency. The modulation frequency may be from about 1 kHz to about 200 kHz.

In an exemplary embodiment of the present invention, the frequency expanding part may receive a control signal including a main clock signal outputted from the external source, and may disperse a frequency band of the main clock signal from about ±1% to about ±3% of a middle frequency of the frequency band of the main clock signal. The middle frequency of the frequency band of the main clock signal may be from about 120 MHz to about 180 MHz.

In an exemplary embodiment of the present invention, the frequency band of the main clock signal may alternate between a lower frequency and an upper frequency based on a modulation frequency from about 1 kHz to about 200 kHz.

In an exemplary embodiment of the present invention, the timing controller may further include a data transition minimize ("DTM") circuit part. The DTM circuit part controls the transmission of one of the previous frame image data, the current frame image data and the dispersed current frame image data to the memory, so that a number of toggles in the one of the previous frame image data, the current frame image data and the dispersed current frame image data transmitted to the memory is less than half of a number of reference bits associated with the one of the previous frame image data, the current frame image data and the dispersed current frame image data transmitted to the memory.

When the number of toggles is greater than or equal to half of the number of reference bits, the data transition minimize circuit part outputs an inversion signal comprising the one of the previous frame image data, the current frame image data and the dispersed current frame image data, inverted on a bit basis, and a polarity signal having a high level to the memory.

Conversely, when the number of toggles is less than half of the number of reference bits, the data transition minimize circuit part outputs the one of the previous frame image data, the current frame image data and the dispersed current frame image data and a polarity signal having a low level to the memory.

In an exemplary embodiment of the present invention, the controller board may further include an output buffer control part which controls a current value of the dispersed current frame image data outputted from the output buffer to the memory. Specifically, the output buffer control part controls the output buffer such that the current value of the dispersed current frame image data outputted from the output buffer to the memory is form about 2 mA to about 8 mA.

The output buffer control part may include an electrically erasable programmable read-only memory ("EEPROM") which stores a setting value corresponding to the current value of the dispersed current frame image data outputted from the output buffer to the memory.

According to an alternative exemplary embodiment of the present invention, a controller board includes a frequency expanding part, a memory and a timing controller. The frequency expanding part disperses, within a reference frequency range, a frequency band of a current frame image data supplied from an external source. The memory stores previous frame image data. The timing controller transmits the current frame image data supplied from the frequency expanding part to the memory and outputs driving image data based on the current frame image data and the previous frame image data supplied from the memory.

In an exemplary embodiment of the present invention, the timing controller may include an output buffer, an input buffer and an image signal processing part. The output buffer receives the current frame image data from the frequency expanding part and outputs the current frame image data to the memory. The input buffer receives the previous frame image data from the memory and outputs the previous frame image data. The image signal processing part receives the current frame image data from the frequency expanding part and the previous frame image data from the input buffer and outputs the driving image data based on the current frame image data and the previous frame image data.

According to still another alternative exemplary embodiment of the present invention, a display device includes a controller board and a display unit. The controller board includes a memory and a timing controller. The memory stores previous frame image data of a previous frame. The timing controller outputs driving image data based on current frame image data supplied from an external source and the previous frame image data. The timing controller disperses a frequency band of the current frame image data within a reference frequency range to generate a dispersed current frame image data and transmits the dispersed current frame image data to the memory. The display unit receives the driving image data to display an image based on the driving image data.

In an exemplary embodiment of the present invention, the controller board may output a gate driving signal and a data driving signal to the display unit based on a control signal applied from the external source.

In an exemplary embodiment of the present invention, the display unit may include a data driving part, a gate driving part and a display part. The data driving part outputs a data signal based on the driving image data and the data driving signal supplied from the controller board. The gate driving part outputs a gate signal based on the gate driving signal supplied from the controller board. The display panel displays the image based on the data signal and the gate signal.

In an exemplary embodiment of the present invention, the driving image data may include data configured to overdrive the display panel to enhance a response time of liquid crystal molecules of the display panel.

In yet another alternative exemplary embodiment of the present invention, a method of controlling display device includes: storing previous frame image data in a memory; dispersing a frequency band of current frame image data within a reference frequency range to generate dispersed current frame image data; transmitting the dispersed current frame image data to the memory; and outputting driving image data based on current frame image data supplied from an external device and the previous frame image data from a timing controller.

The method may further include: generating the dispersed current frame image data by dispersing the frequency band of the current frame image data supplied from the external device within the reference frequency range with a frequency expanding part; receiving the dispersed current frame image data from the frequency expanding part with an output buffer which outputs the dispersed current frame image data to the memory; receiving the previous frame image data from the memory with an input buffer which outputs the previous frame image data; and receiving the dispersed current frame image data from the frequency expanding part and the previous frame image data from the input buffer with an image signal processing part which outputs the driving image data based on the current frame image data and the previous frame image data.

The reference frequency range may be from about plus or minus 1 percent to about plus or minus 3 percent of a middle frequency of the frequency band of the current frame image data.

According to exemplary embodiments of the present invention, a frequency band of current frame image data is dispersed, a number of toggles of a signal transferred from a timing controller to a memory is maintained to be less than approximately half of a number of reference bits, and a current value of a signal outputted from an output buffer of the timing controller is controlled. As a result, amplitudes of EMI generated by the signal outputted from the timing controller to the memory are substantially decreased and/or effectively minimized.

BRIEF DESCRIPTION OF THE DRAWINGS

The above and other aspects, features and advantages of the present invention will become more readily apparent by describing in further detail exemplary embodiments thereof with reference to the accompanying drawings, in which.

DETAILED DESCRIPTION OF THE INVENTION

Figure 1:
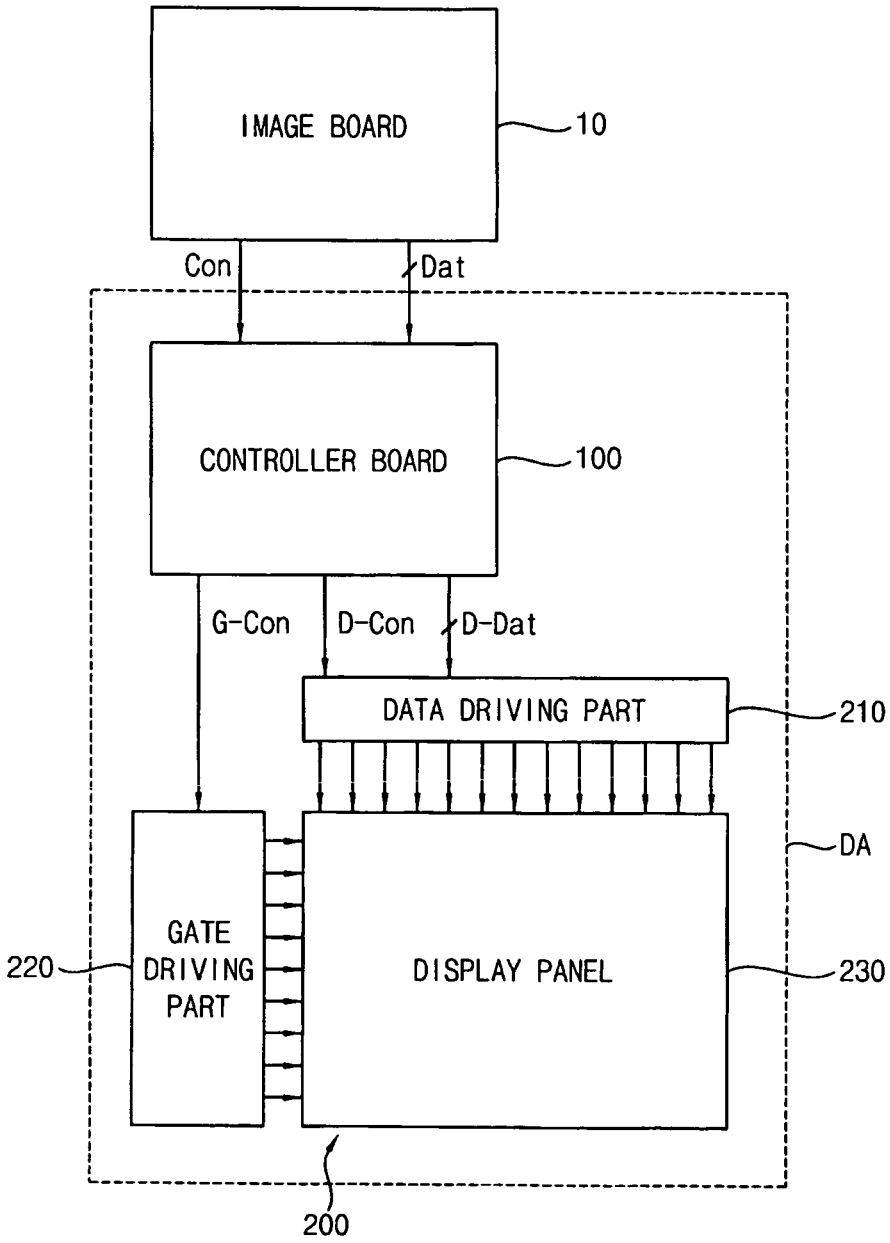
FIG. 1 is a block diagram showing an exemplary embodiment of a display device according to the present invention.

The invention will now be described more fully hereinafter with reference to the accompanying drawings, in which exemplary embodiments of the invention are shown. The present invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including," when used in this specification, specify the presence of stated features, regions, integers, steps, operations, elements and/or components, but do not preclude the presence or addition of one or more other features, regions, integers, steps, operations, elements, components and/or groups thereof.

Furthermore, relative terms, such as "lower" or "bottom" and "upper" or "top" may be used herein to describe one element's relationship to other elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on the "upper" side of the other elements. The exemplary term "lower" can, therefore, encompass both an orientation of "lower" and "upper," depending upon the particular orientation of the figure. Similarly, if the device in one of the figures were turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning which is consistent with their meaning in the context of the relevant art and the present disclosure, and will not be interpreted in an idealized or overly formal sense unless expressly so defined herein.

Exemplary embodiments of the present invention are described herein with reference to cross section illustrations which are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes which result, for example, from manufacturing. For example, a region illustrated or described as flat may, typically, have rough and/or nonlinear features. Moreover, sharp angles which are illustrated may be rounded. Thus, the regions illustrated in the figures are schematic in nature and their shapes are not intended to illustrate the precise shape of a region and are not intended to limit the scope of the present invention.

Hereinafter, exemplary embodiments of the present invention will be described in further detail with reference to the accompanying drawings.

FIG. 1 is a block diagram showing an exemplary embodiment of a display device according to the present invention.

Referring to FIG. 1, a display device DA according to an exemplary embodiment of the present invention includes a controller board 100 and a display unit 200. The controller board 100 receives a control signal Con and image data Dat for a current frame from an image board 10. In an exemplary embodiment of the present invention, the image board 10 is external to the display device DA, as shown in FIG. 1. The controller board 100 outputs a data control signal D-Con, a gate control signal G-Con and driving image data D-Dat in response to the control signal Con and the image data Dat for the current frame. The controller board 100 will be described in further detail below with reference to FIGS. 2 and 3.

Still referring to FIG. 1, the display unit 200 receives the data control signal D-Con, the gate control signal G-Con and the driving image data D-Dat from the controller board 100, and displays an image based on the data control signal D-Con, the gate control signal G-Con and the driving image data D-Dat.

In an exemplary embodiment of the present invention, the display unit 200 includes a data driving part 210, a gate driving part 220 and a display panel 230.

The data driving part 210 receives the data control signal D-Con and the driving image data D-Dat from the controller board 100. The data driving part 210 provides the display panel 230 with a data signal based on the data control signal D-Con and the driving image data D-Dat.

The gate driving part 220 receives the gate control signal G-Con from the controller board 100, and provides the display panel 230 with a gate signal based on to the gate control signal G-Con.

Thus, the display panel 230 receives the data signal from the data driving part 210, and receives the gate signal from the gate driving part 220. In addition, the display panel 230 displays the image based on the data signal and the gate signal.

The display panel 230 according to an exemplary embodiment of the present invention may include, for example, a first substrate (not shown), a second substrate (not shown) and a liquid crystal layer (not shown).

Further, the first substrate includes a plurality of gate lines which receives the gate signal, a plurality of data lines which receives the data signal, a plurality of thin-film transistors ("TFTs") electrically connected to gate lines of the plurality of gate and data lines of the plurality of data lines, and a plurality of pixel electrodes each electrically connected to a TFT of the plurality of TFTs.

The second substrate is disposed opposite to, e.g., facing, the first substrate. The second substrate includes a plurality of color filters disposed corresponding to pixel electrodes of the plurality of pixel electrodes and a common electrode formed on a surface thereof. Alternatively, the plurality of color filters may be disposed on the first substrate.

The liquid crystal layer is interposed between the first substrate and the second substrate. In operation, an electric field is applied to the liquid crystal layer, and an arrangement of liquid crystal molecules in the liquid crystal layer is altered to change an optical transmissivity therethrough, and a desired image is thereby displayed.

The display device according to an exemplary embodiment may further include a backlight assembly (not shown) disposed below the display panel 230 to provide light to the display panel 230.

Figure 2:
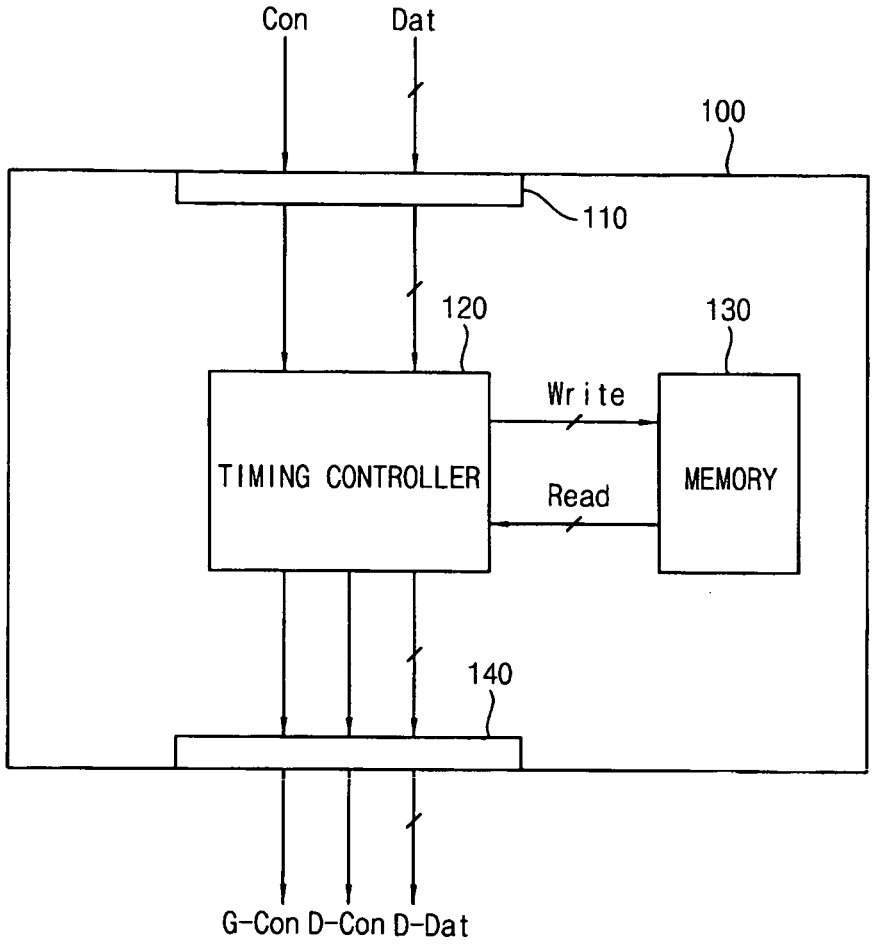
FIG. 2 is a block diagram showing an exemplary embodiment of a controller board of the display device according to the exemplary embodiment of the present invention shown in FIG. 1.

FIG. 2 is a block diagram showing an exemplary embodiment of a controller board of the display device according to the exemplary embodiment of the present invention shown in FIG. 1.

Referring to FIGS. 1 and 2, the controller board 100 includes a signal receiving part 110, a timing controller 120, a memory 130 and a signal output part 140.

The signal receiving part 110 receives the control signal Con and the frame image data Dat for the current frame (hereinafter referred to as "current frame image data Dat") from the image board 10. The signal receiving part 110 changes, e.g., converts, the control signal Con and the frame image data Dat into signals having respective levels which are used in the controller board 100. In an exemplary embodiment of the present invention, the control signal Con may include a main clock signal (not shown) and a plurality of image control signals (not shown), but alternative exemplary embodiments are not limited thereto.

The timing controller 120 receives the control signal Con and the current frame image data Dat from the signal receiving part 110. The timing controller 120 transmits the current image data Dat to the memory 130, and receives a previous frame image data Dat' (described in further detail below with reference to FIG. 3) stored in the memory 130.

The timing controller 120 outputs the driving image data for displaying the image using the current frame image data Dat and the previous frame image data Dat'. In addition, the timing controller 120 outputs the data control signal D-Con and the gate control signal G-Con based on the control signal Con.

To enhance a response time of the liquid crystal molecules in the display panel 230, the driving image data D-Dat outputted from the timing controller 120 may overdrive the display panel 230.

As will be described in greater detail below with reference to FIGS. 4 and 5, the timing controller 120 disperses a frequency band of the current frame image data Dat within a reference frequency range. Thereafter, the timing controller 120 transmits the current frame image data Dat, having the dispersed frequency band, to the memory 130. In an exemplary embodiment, the frequency band of the current frame image data Dat is dispersed within a predetermined range which is identified in, e.g., is stored in, the memory 130.

Figure 3:
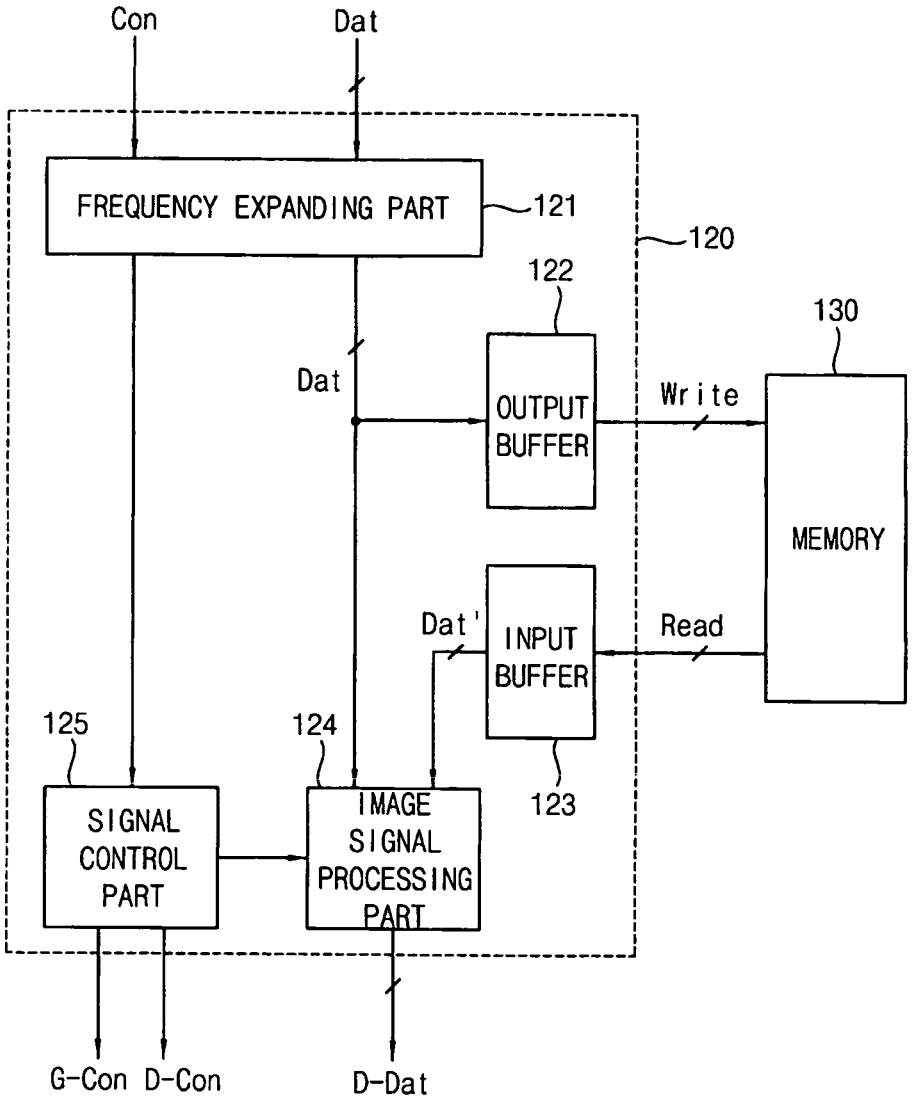
FIG. 3 is a block diagram showing an exemplary embodiment of a timing controller of the controller board according to the exemplary embodiment of the present invention shown in FIG. 2.

The timing controller 120 reads data from and writes data to the memory 130. Specifically, the memory 130 stores image data for at least one frame. More specifically, the memory 130 receives at least the current frame image data Dat from the timing controller 120, and stores the current frame image data Dat and the previous frame image data Dat' (FIG. 3). The memory 130 transmits the previous frame image data Dat' stored therein to the timing controller 120.

The timing controller 120 and the memory 130 exchange signals having units measured by a number of reference bits. In an exemplary embodiment of the present invention, for example, signals exchanged between the timing controller 120 and the memory 130 (e.g., the current frame image data Dat and the previous frame image data Dat') may each include 32 bits. Moreover, the timing controller 120 and the memory 130 may the signals through substantially the same signal lines. Specifically, the timing controller 120 and the memory 130 may exchange different signal using the same signal lines by time-division multiplexing, e.g., by dividing time into writing intervals and reading intervals.

When the memory 130 transmits the previous frame image data Dat' to the timing controller, the memory 130 may disperse a frequency band of the previous frame image data Dat' within the reference range.

The signal output part 140 receives the data control signal D-Con, the gate control signal G-Con and the driving image data D-Dat from the timing controller 120. The signal receiving part 110 alters, e.g., converts, the data control signal D-Con, the gate control signal G-Con and the driving image data D-Dat into signals having levels at which the signals may be easily transferred.

FIG. 3 is a block diagram showing an exemplary embodiment of a timing controller of the controller board according to the exemplary embodiment of the present invention shown in FIG. 2.

Referring to FIGS. 2 and 3, the timing controller 120 according to an exemplary embodiment of the present invention includes a frequency expanding part 121, an output buffer 122, an input buffer 123, an image signal processing part 124 and a signal control part 125.

The frequency expanding part 121 receives the control signal Con and the current frame image data Dat from the signal receiving part 110. The frequency expanding part 121 disperses a frequency band of the control signal Con and a frequency band of the current frame image data Dat within the reference range, as will be described in further detail below.

The output buffer 122 receives the current frame image data Dat having the dispersed frequency band from the frequency expanding part 121. In an exemplary embodiment, he output buffer 122 may change, e.g., convert, the current frame image data Dat to have a signal level at which the current frame image data Dat may be easily transferred, such as approximately 3.3 V, for example, and outputs the signal level-converted current frame image data Dat to the memory 130. The output buffer 122 also transmits the current frame image data Dat to the memory 130 in units based on a number of reference bits, such as 32 bits, for example.

The input buffer 123 receives the previous frame image data Dat' from the memory 130 in units also based on the number of the reference bits, e.g., the 32 bits. Further, the input buffer 123 may change, e.g., convert, a level of the previous frame image data Dat' received from the memory 130 into a signal level used by the timing controller.

The image signal processing part 124 receives the current frame image data Dat from the frequency expanding part 121, and receives the previous frame image data Dat' from the input buffer 123. The image signal processing part 124 outputs the driving image data D-Dat in response to the current frame image data Dat and the previous frame image data Dat'.

The image signal processing part 124 according to an exemplary embodiment of the present invention may include a dynamic capacitance compensation ("DCC") processing part (not shown) which generates the driving image data D-Dat using the current frame image data Dat and the previous frame image data Dat'. In an exemplary embodiment, for example, the DCC processing method uses a data voltage which is higher or, alternatively, lower than a target data voltage which is applied to the pixels. As a result, a response time to reach a target light transmittance, as well as to compensate for a difference between the target light transmittance and the pixel light transmittance at a beginning portion of a given frame, is substantially improved. The DCC processing part may include a DCC lookup table ("LUT") (not shown) which compares the current frame image data Dat with the previous frame image data Dat' to determine an overshoot value used to improve the response time.

The signal control part 125 receives the control signal Con from the frequency expanding part 121. The signal control part 125 outputs the data control signal D-Con and the gate control signal G-Con based on the control signal Con. The signal control part 125 according to an exemplary embodiment may control the image signal processing part 124 based on the control signal Con.

Figure 4:
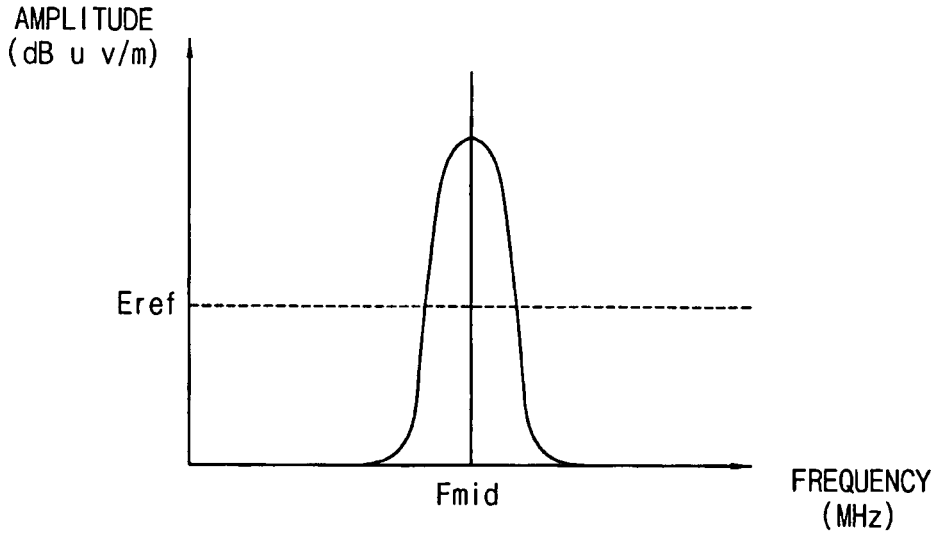
FIG. 4 is a graph of frequency versus amplitude showing a frequency band of image data before passing through a frequency expanding part of the timing controller according to the exemplary embodiment of the present invention shown in FIG. 3.

FIG. 4 is a graph of frequency versus amplitude showing a frequency band of image data before passing through the frequency expanding part according to the exemplary embodiment of the present invention shown in FIG. 3. FIG. 5 is a graph of frequency versus amplitude showing a dispersed frequency band of image data after passing through the frequency expanding part according to the exemplary embodiment of the present invention shown in FIG. 3.

Referring to FIGS. 3 and 4, a frequency band of the current frame image data Dat before passing through the frequency expanding part 121 includes one middle frequency Fmid corresponding to a peak frequency. Thus, the current frame image data Dat, prior to passing through the frequency expanding part 121, includes the middle frequency Fmid regardless time. In an exemplary embodiment of the present invention, the middle frequency Fmid of the frequency band of the current frame image data Dat may be in a range of approximately 60 MHz to approximately 90 MHz. In addition, the middle frequency Fmid may be approximately 75 MHz in an exemplary embodiment.

An amplitude corresponding to the middle frequency Fmid of FIG. 4 has a higher value than a reference electromagnetic interference ("EMI") amplitude Eref. In an exemplary embodiment of the present invention, the reference EMI amplitude Eref denotes an amplitude of an electric field which has minimal effects, e.g., non-detrimental effects, on external electronic devices or a human users, for example which is exposed to the electric field.

When the timing controller 120 transmits a signal which has a frequency amplitude above the reference EMI amplitude to the memory 130, a strong electric field from the timing controller 120 has adverse effects on external electronic devices or humans, for example.

Figure 5:
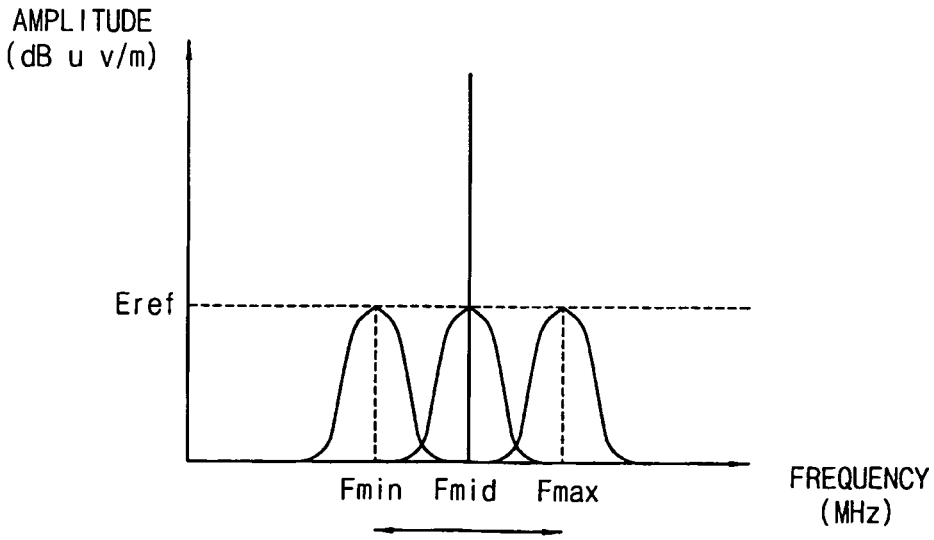
FIG. 5 is a graph of frequency versus amplitude showing a dispersed frequency band of image data after passing through the frequency expanding part according to the exemplary embodiment of the present invention shown in FIG. 3.

Referring to FIGS. 3 and 5, a frequency band of the current frame image data Dat is dispersed within the reference range with respect to a middle frequency Fmid after passing through the frequency expanding part 121. In an exemplary embodiment of the present invention, the reference range may be approximately ±1% to approximately ±3% with respect to the middle frequency Fmid. In an exemplary embodiment, for example, the reference range is approximately ±1.5% of the middle frequency Fmid. Further, the reference range according to an exemplary embodiment may be determined by a margin width of a frequency which can be identified by the memory 130, but alternative exemplary embodiments of the present invention are not limited thereto.

The frequency of the current frame image data Dat may be altered by a modulation frequency between a minimum frequency Fmin and a maximum frequency Fmax within the reference range by passing through the frequency expanding part 121. In an exemplary embodiment of the present invention, for example, when the reference range is approximately ±1.5% of the middle frequency Fmid, the minimum frequency Fmin is approximately −1.5% of the middle frequency Fmid and the maximum frequency Fmax is approximately +1.5% of the middle frequency Fmid.

The modulation frequency according to an exemplary embodiment of the present invention may be in a range of approximately 1 kHz to approximately 200 kHz. Specifically, when the modulation frequency is approximately 100 kHz, for example, a frequency of the current frame image data Dat oscillates between the minimum frequency Fmid and the maximum frequency Fmax approximately 100,000 times per second.

Referring to FIG. 5, a frequency band of the current frame image data Dat after passing through the frequency expanding part 121 is dispersed into three frequency bands, but alternative exemplary embodiments of the present invention are not limited thereto. Specifically, as shown in FIG. 5, the frequency band of the current frame image data Dat has a minimum frequency Fmin, a middle frequency Fmid and a maximum frequency Fmax (corresponding to three temporally separated amplitude peaks) after passing through the frequency expanding part 121. In addition, the frequency band of the current frame image data Dat after passing through the frequency expanding part 121 may be altered over time, e.g., in subsequent frames.

When the frequency band of the current frame image data Dat is dispersed into a plurality of frequencies, e.g., into the minimum frequency Fmin, the middle frequency Fmid and the maximum frequency Fmax, each corresponding peak value of the frequencies is less than the reference EMI amplitude, as shown in FIG. 5. As a result, malfunctions due EMI from the timing controller 120 may be decreased, thereby reducing adverse effects on external electronic devices or human operators exposed to the EMI, for example.

In an exemplary embodiment of the present invention, the dispersing principle of the frequency band of the current frame image data Dat described above may be employed in a frequency band of the control signal Con.

In an exemplary embodiment of the present invention, for example, the frequency band of the main clock signal of the control signal Con may be dispersed within a range between approximately ±1% and approximately ±3% with respect to the middle frequency Fmid. Further, the middle frequency Fmid of the frequency band of the main clock signal according to an exemplary embodiment of the present invention may be in a range from approximately 120 MHz to approximately 180 MHz. The middle frequency of the frequency band of the main clock signal may be, for example, approximately 150 MHz. Moreover, the frequency of the main clock signal may be altered between a minimum frequency and a maximum frequency in a modulation frequency of approximately 1 kHz to approximately 200 kHz, respectively.

Figure 6:
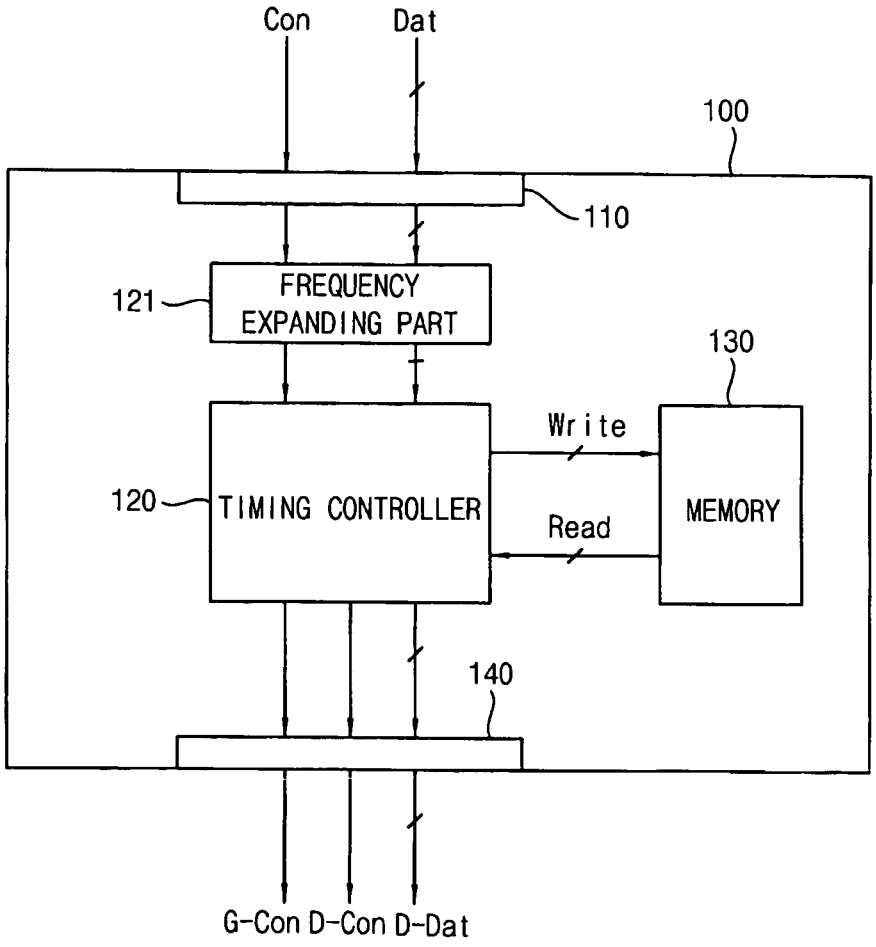
FIG. 6 is a block diagram showing an alternative exemplary embodiment of a timing controller according to the present invention.

FIG. 6 is a block diagram showing an alternative exemplary embodiment of a timing controller according to the present invention.

Referring to FIG. 6, the frequency expanding part 121 in an exemplary embodiment of the present invention may be disposed at a position wherein the timing controller 120 is not disposed, e.g., outside the timing controller 120, instead of being disposed within the timing controller 120 (as shown in the exemplary embodiment of the present invention shown in FIG. 3.).

In an exemplary embodiment of the present invention, for example, the frequency expanding part 121 may be disposed between the signal receiving part 110 and the timing controller 120. As described above in greater detail, the frequency expanding part 121 receives the control signal Con and the current frame image data Dat. In addition, the frequency expanding part 121 disperses frequency bands of the control signal Con and the current frame image data Dat to output the dispersed frequency bands to the timing controller 120.

The timing controller 120 outputs the data control signal D-Con and the gate control signal G-Con to the signal output part 140 based on the control signal Con supplied from the frequency expanding part 121.

Moreover, the timing controller 120 transmits the current frame image data Dat supplied from the frequency expanding part 121 to the memory 130, and receives the previous frame image data Dat' from the memory 130. The timing controller 120 outputs the driving image data D-Dat to the signal output part 140 based on the current frame image data Dat and the previous frame image data Dat', as will be described in further detail below.

Thus, according to an exemplary embodiment of the present invention, as a frequency band of current frame image data is dispersed into a plurality of frequencies within a reference range of frequencies, a peak amplitude of each frequency of the plurality of frequencies decreases, and each peak value is less than a reference EMI amplitude. As a result, malfunctions due to EMI signals generated in the timing controller and are outputted to a memory are substantially decreased, thereby effectively reducing adverse effects on external electronic devices or a human operator, for example, which are exposed to the EMI signals.

Figure 7:
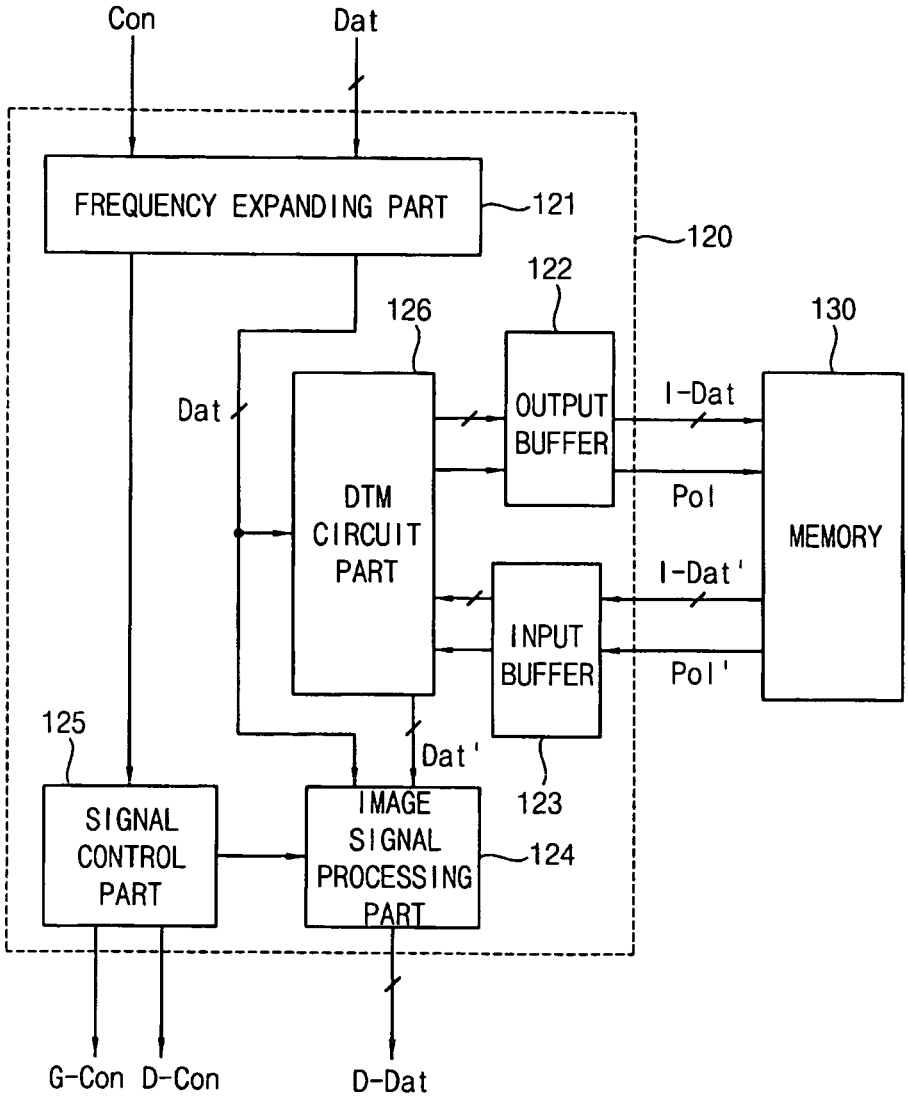
FIG. 7 is a block diagram showing an alternative exemplary embodiment of a timing controller and a memory of a display device according to the present invention.

FIG. 7 is a block diagram showing an exemplary embodiment of a timing controller and a memory of a display device according to the present invention.

The display device according to the exemplary embodiment of the present invention shown in FIG. 7 is substantially the same as the display device DA described in further detail above with reference to FIGS. 1 to 6, except for a data transition minimize ("DTM") circuit part 126. Thus, the same reference characters are used in FIG. 7 to refer to the same or like components as those shown in FIGS. 1 to 6, and thus, any repetitive detailed description thereof will hereinafter be omitted.

Referring to FIG. 7, the DTM circuit part 126 of a display device DA according to an exemplary embodiment of the present invention is included in the timing controller 120 to receive the current frame image data Dat from the frequency expanding part 121.

When the current frame image data Dat is transmitted to the memory 130 through the output buffer 122 (in units based on a number of reference bits, for example, 32 bits, as described above in greater detail) the DTM circuit part 126 controls a transmission of data, such that a number of toggles of transmitting data transmitted to the memory 130 is approximately half of a number of the reference bits (e.g., 16 bits).

In an exemplary embodiment of the present invention, for example, when a number of toggles of the transmitting data transmitted to the memory 130 is greater than or equal to half of the number of the reference bits, the DTM circuit part 126 outputs an inversion data I-Dat into which the transmitting data is inverted (on a bit basis) and a polarity signal Pol having a high level to the memory 130. Conversely, when a number of toggles of the transmitting data transmitted to the memory 130 is less than half of the number of the reference bits, the DTM circuit part 126 outputs the inversion data I-Dat, into which the transmitting data is not inverted, and a polarity signal Pol having a low level to the memory 130. As a result, the number of toggles of a signal transmitted from the timing controller 120 to the memory 130 is reduced to less than the number of the reference bits.

More specifically, the DTM circuit part 126 receives a previous frame image data I-Dat' stored in the memory 130 and a previous frame polarity signal Pol' through the input buffer 123. Thus, when a polarity of the previous frame polarity signal Pol' has the high level, the DTM circuit part 126 outputs an inverted previous frame data Dat' into which the previous frame image data I-Dat' is inverted to the image signal processing part 124.

Therefore, according to an exemplary embodiment of the present invention, since the number of toggles of a transmitting data transmitted from the timing controller 120 to the memory 130 is less than half of the number of the reference bits, malfunctions due to signals generated from the timing controller 120 to be outputted to the memory 130 are substantially decreased, thereby effectively reducing adverse effects of EMI on external electronic devices or a human operator, for example.

Figure 8:
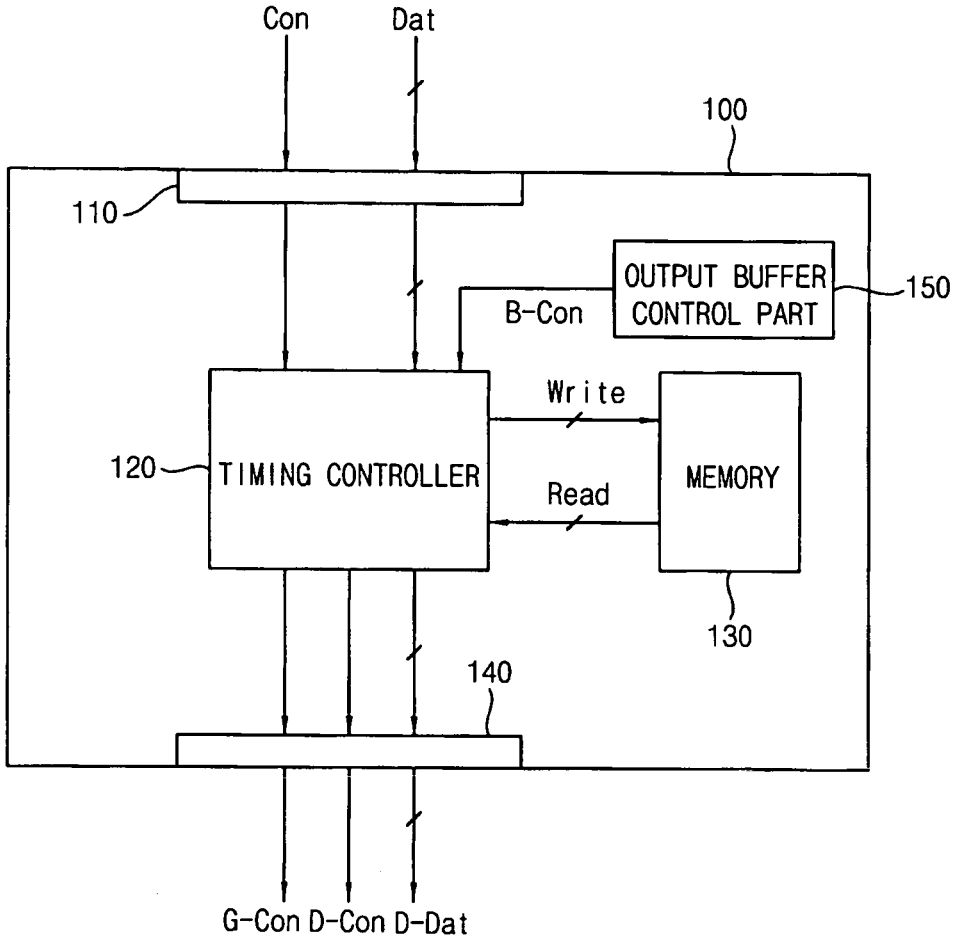
FIG. 8 is a block diagram showing an exemplary embodiment of a controller board of the display device according to the exemplary embodiment of the present invention shown in FIG. 7.
Figure 9:
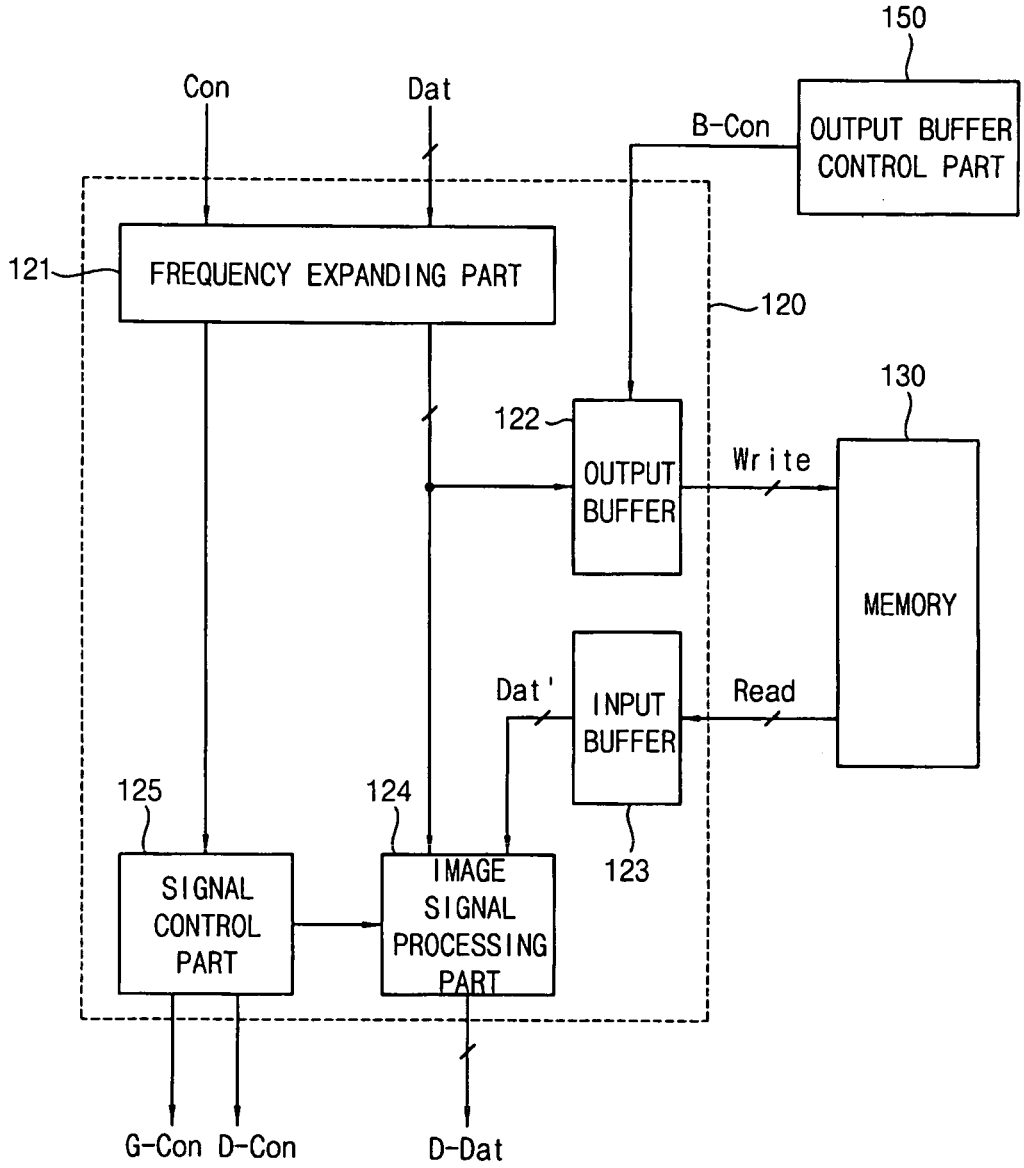
FIG. 9 is a block diagram showing an exemplary embodiment of a timing controller according to the exemplary embodiment of the present invention shown in FIG. 8.

FIG. 8 is a block diagram showing an alternative exemplary embodiment of a controller board of a display device according to the present invention. FIG. 9 is a block diagram showing an exemplary embodiment of a timing controller of the display device according to the exemplary embodiment of the present invention shown in FIG. 8.

The display device according to the exemplary embodiment shown in FIGS. 8 and 9 is substantially the same as the display device DA according to the exemplary embodiment of the present invention described in greater detail above with reference to FIGS. 1 to 6, except for an output buffer control part 150. Thus, the reference characters are used in FIGS. 8 and 9 to refer to the same or like components as those shown in FIGS. 1 to 6, and thus, any repetitive detailed description thereof will hereinafter be omitted.

Referring now to FIGS. 8 and 9, the output buffer control part 150 is disposed at an outer peripheral area of the timing controller 120 to control the timing controller 120.

Specifically, the output buffer control part 150 controls a current value of a signal outputted from the timing controller 120 to the memory 130. More specifically, the output buffer control part 150 outputs an output buffer control signal B-Con to the timing controller 120. Thus, the output buffer control part 150 provides the output buffer 122 with the output buffer control signal B-Con to control the current value of a signal transmitted from the output buffer 122 to the memory 130.

In an exemplary embodiment, the output buffer control part 150 controls the current value of a signal transmitted from the output buffer 122 to the memory 130 within a range of approximately 2 mA to approximately 8 mA. However, as the current value of the signal transmitted from the output buffer 122 to the memory 130 increases, an amplitude of EMI generated by an output signal of the output buffer 122 increases.

Therefore, the current value of the signal according to an exemplary embodiment of the present invention is approximately 2 mA. Additionally, however, a signal outputted from the output buffer 122 is distorted when the current value of the signal is sufficiently low, and the signal may therefore not be identified by the memory 130. Thus, the current value of the signal outputted from the output buffer 122 may have a minimum value within a range which will be identified by the memory 130. In an exemplary embodiment of the present invention, for example, the current value of the signal may be approximately 4 mA, but alternative exemplary embodiments are not limited thereto.

The output buffer control part 150 according to an exemplary embodiment of the present invention may include an electrically erasable programmable read-only memory ("EEPROM") which stores a setting value corresponding to the current value of a signal outputted from the output buffer 122. Specifically, in an exemplary embodiment, for example, when the EEPROM has a setting value of "00", the output buffer 122 may output a signal of approximately 2 mA. Further, when the EEPROM has a setting value of "01", for example, the output buffer 122 may output a signal of approximately 4 mA. In addition, when the EEPROM has a setting value of "10", for example, the output buffer 122 may output a signal of approximately 6 mA. Additionally, when the EEPROM has a setting value of "11", the output buffer 122 may output a signal of approximately 8 mA.

Thus, according to an exemplary embodiment, the output buffer control part 150 controls the output buffer 122, and the current value of the signal outputted from the output buffer 122 may be at a minimum value within a predetermined range which is identified by the memory 130. Thus, malfunctions due to signals generated from the timing controller 120 to be outputted to the memory 130 are substantially decreased, thereby reducing adverse effects on external electronic devices or a human operator, for example.

In addition, the controller board 100 according to yet another alternative exemplary embodiment of the present invention may include the frequency expanding part 121 (FIG. 3), the DTM circuit part 126 (FIG. 7) and/or the output buffer control part 155 (FIG. 8). Alternatively, the controller board 100 according to an exemplary embodiment of the present invention may include any and all combinations of the aforementioned elements. For example, the controller board according to an exemplary embodiment of the present invention may include one of the abovementioned element, or, alternative, two of the abovementioned elements.

Figure 10A:
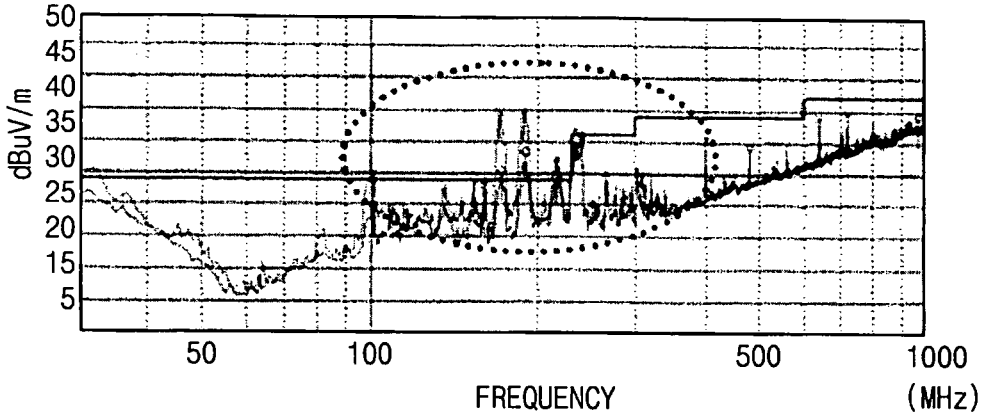
FIG. 10A (PRIOR ART)
FIG. 10A is a graph of frequency versus amplitude of a display device of the prior art.
Figure 10B:
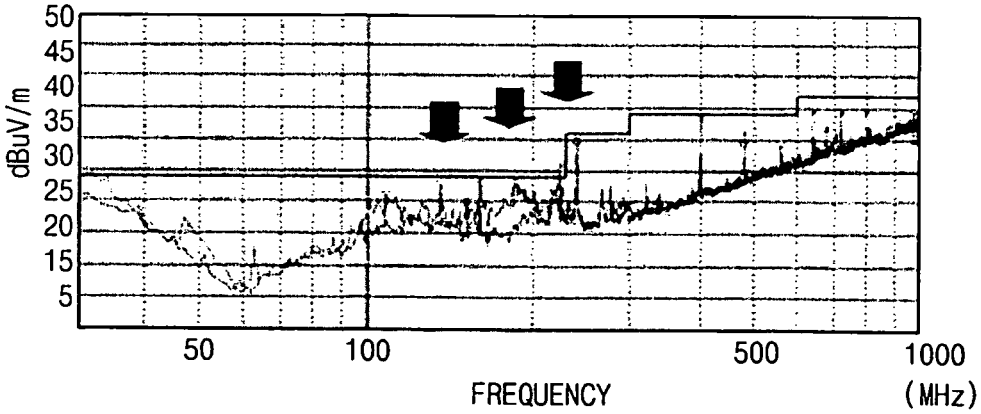
FIG. 10B is a graph of frequency versus amplitude of a display device according to an exemplary embodiment of the present invention.

FIG. 10A is a graph of frequency versus amplitude of a display device of the prior art, and FIG. 10B is a graph of frequency versus amplitude of a display device according to an exemplary embodiment of the present invention.

Referring to FIGS. 10A and 10B, when the controller board 100 according to an exemplary embodiment of the present invention includes the frequency expanding part 121, the DTM circuit part 126 and the output buffer control part 150, an amplitude of an EMI signal outputted from the controller board 100 to the memory 130 is substantially reduced as compared to a display device having a controller board of the prior art.

Specifically, as shown in FIG. 10A, an amplitude of an EMI signal outputted from a controller board of the prior art to a memory thereof is approximately 35 dBμV/m in a frequency band of approximately 150 MHz to approximately 350 MHz.

In contrast and as illustrated in FIG. 10B, when the frequency expanding part 121, the DTM circuit part 126 and the output buffer control part 150 are included in the controller board 100 according to an exemplary embodiment of the present invention, an amplitude of an EMI signal outputted from the conventional controller board 100 to the memory 130 is approximately 25 dBμV/m in a frequency band of approximately 150 MHz to approximately 350 MHz.

Thus, according to exemplary embodiments of the present invention as described herein, in a display device, a frequency band of current frame image data is dispersed, and a number of toggles of a signal transferred from a timing controller to a memory is thereby less than half of a number of reference bits, and a current value of a signal outputted from an output buffer of the timing controller is controlled as a minimum value, identified by the timing controller, and an amplitude of EMI generated by the signal outputted from the timing controller to the memory is therefore substantially decreased and/or effectively minimized. As a result, malfunctions due to signals generated from the timing controller to be outputted to the memory are substantially decreased and/or effectively minimized, thereby reducing adverse effects of an EMI signal on external electronic devices and/or a human user of the display device, either or both of which may be subjected to the EMI signal.

The present invention should not be construed as being limited to the exemplary embodiments set forth herein. Rather, these exemplary embodiments are provided so that this disclosure will be thorough and complete and will fully convey the concept of the present invention to those skilled in the art.

For example, in an alternative exemplary embodiment of the present invention, a method of controlling a display device includes: storing previous frame image data in a memory; dispersing a frequency band of current frame image data within a reference frequency range to generate dispersed current frame image data; transmitting the dispersed current frame image data to the memory; and outputting driving image data based on current frame image data supplied from an external device and the previous frame image data from a timing controller. The method may further include: generating the dispersed current frame image data by dispersing the frequency band of the current frame image data supplied from the external device within the reference frequency range with a frequency expanding part; receiving the dispersed current frame image data from the frequency expanding part with an output buffer which outputs the dispersed current frame image data to the memory; receiving the previous frame image data from the memory with an input buffer which outputs the previous frame image data; and receiving the dispersed current frame image data from the frequency expanding part and the previous frame image data from the input buffer with an image signal processing part which outputs the driving image data based on the current frame image data and the previous frame image data. The reference frequency range may be from about plus or minus 1 percent to about plus or minus 3 percent of a middle frequency of the frequency band of the current frame image data.

While the present invention has been particularly shown and described with reference to exemplary embodiments thereof, it will be understood by those of ordinary skill in the art that various changes in form and details may be made therein without departing from the spirit or scope of the present invention as defined by the following claims.

What is claimed is:

1. A controller board comprising:

a memory which stores previous frame image data; and a timing controller which outputs driving image data based on current frame image data supplied from an external source and the previous frame image data, the timing controller dispersing a frequency band of the current frame image data within a reference frequency range to generate dispersed current frame image data and transmitting the dispersed current frame image data to the memory, wherein the timing controller comprises:

a frequency expanding part which generates the dispersed current frame image data by dispersing the frequency band of the current frame image data supplied from the external source within the reference frequency range; and an input buffer which receives the previous frame image data from the memory and outputs the previous frame image data;

an output buffer which receives the dispersed current frame image data from the frequency expanding part and outputs the dispersed current frame image data to the memory; and an image signal processing part which receives the dispersed current frame image data and the previous frame image data to output the driving image data based on the current frame image data and the previous frame image data, wherein the image signal processing part receives the dispersed current frame image data from the frequency expanding part and the previous frame image data from the input buffer.

2. The controller board of claim 1, wherein the reference frequency range is from about plus or minus 1 percent to about plus or minus 3 percent of a middle frequency of the frequency band of the current frame image data.

3. The controller board of claim 2, wherein the middle frequency of the frequency band of the current frame image data is from about 60 MHz to about 90 MHz.

4. The controller board of claim 1, wherein a frequency of the current frame image data is alternated between a lower frequency and an upper frequency based on a modulation frequency.

5. The controller board of claim 4, wherein the modulation frequency is from about 1 kHz to about 200 kHz.

6. The controller board of claim 1, wherein the frequency expanding part receives a control signal including a main clock signal outputted from the external source, and the frequency expanding part disperses a frequency band of the main clock signal from about plus or minus 1 percent to about plus or minus 3 percent of a middle frequency of the frequency band of the main clock signal.

7. The controller board of claim 6, wherein the middle frequency of the frequency band of the main clock signal is from about 120 MHz to about 180 MHz.

8. The controller board of claim 6, wherein the frequency band of the main clock signal is alternated between a lower frequency and an upper frequency based on a modulation frequency, and the modulation frequency is from about 1 kHz to about 200 kHz.

9. The controller board of claim 1, wherein the timing controller further comprises a data transition minimize circuit part which controls transmission of one of the previous frame image data, the current frame image data and the dispersed current frame image data to the memory, and a number of toggles in the one of the previous frame image data, the current frame image data and the dispersed current frame image data transmitted to the memory is less than half of a number of reference bits associated with the one of the previous frame image data, the current frame image data and the dispersed current frame image data transmitted to the memory.

10. The controller board of claim 9, wherein when the number of toggles is greater than or equal to half of the number of reference bits, the data transition minimize circuit part outputs an inversion signal comprising the one of the previous frame image data, the current frame image data and the dispersed current frame image data, inverted on a bit basis, and a polarity signal having a high level to the memory, and when the number of toggles is less than half of the number of reference bits, the data transition minimize circuit part outputs the one of the previous frame image data, the current frame image data and the dispersed current frame image data and a polarity signal having a low level to the memory.

11. The controller board of claim 1, further comprising an output buffer control part which controls a current value of the dispersed current frame image data outputted from the output buffer to the memory.

12. The controller board of claim 11, wherein the current value of the dispersed current frame image data outputted from the output buffer to the memory is from about 2 mA to about 8 mA.

13. The controller board of claim 11, wherein the output buffer control part comprises an electrically erasable programmable read-only memory which stores a setting value corresponding to the current value of the dispersed current frame image data outputted from the output buffer to the memory.

14. A display device comprising:

a controller board comprising:

a memory which stores previous frame image data; and a timing controller which outputs driving image data based on current frame image data supplied from an external source and the previous frame image data, the timing controller dispersing a frequency band of the current frame image data within a reference frequency range to generate dispersed current frame image data and transmitting the dispersed current frame image data to the memory; and a display unit which receives the driving image data to display an image based on the driving image data, wherein the timing controller comprises:

a frequency expanding part which generates the dispersed current frame image data by dispersing the frequency band of the current frame image data supplied from the external source within the reference frequency range; and an input buffer which receives the previous frame image data from the memory and outputs the previous frame image data;

an output buffer which receives the dispersed current frame image data from the frequency expanding part and outputs the dispersed current frame image data to the memory; and an image signal processing part which receives the dispersed current frame image data and the previous frame image data to output the driving image data based on the current frame image data and the previous frame image data, wherein the image signal processing part receives the dispersed current frame image data from the frequency expanding part and the previous frame image data from the input buffer.

15. The display device of claim 14, wherein the controller board further outputs a gate driving signal and a data driving signal to the display unit based on a control signal supplied from the external source.

16. The display device of claim 15, wherein the display unit comprises:

a data driving part which outputs a data signal based on the driving image data and the data driving signal supplied from the controller board;

a gate driving part which outputs a gate signal based on the gate driving signal supplied from the controller board; and a display panel which displays the image based on the data signal and the gate signal, wherein the driving image data comprises data configured to overdrive the display panel to enhance a response time of liquid crystal molecules of the display panel.

17. A method of controlling a display device, the method comprising:

storing previous frame image data in a memory;

dispersing a frequency band of current frame image data within a reference frequency range to generate dispersed current frame image data;

transmitting the dispersed current frame image data to the memory;

receiving the dispersed current frame image data from a frequency expanding part with an output buffer which outputs the dispersed current frame image data to the memory;

receiving the dispersed current frame image data from the frequency expanding part and the previous frame image data from an input buffer with an image signal processing part which outputs the driving image data based on the current frame image data and the previous frame image data;

outputting driving image data based on current frame image data supplied from an external device and the previous frame image data from a timing controller;

generating the dispersed current frame image data by dispersing the frequency band of the current frame image data supplied from the external device within the reference frequency range with the frequency expanding part; and receiving the previous frame image data from the memory with the input buffer which outputs the previous frame image data.

18. The method of claim 17, wherein the reference frequency range is from about plus or minus 1 percent to about plus or minus 3 percent of a middle frequency of the frequency band of the current frame image data.

* * * * *